United States Patent [19]

Stiebritz et al.

[11] 4,378,690

[45] Apr. 5, 1983

[54] DIAMOND DRAWING DIE AND SETTING COMBINATION

[75] Inventors: Wolfram Stiebritz, Königsbrunn; Georg Sitterer, Graben; Klaus Seidel, Mittelstetten, all of Fed. Rep. of Germany

[73] Assignee: Patent-Treuhand-Gesellschaft für Elektrische Glühlampen mbH, Munich, Fed. Rep. of Germany

[21] Appl. No.: 223,224

[22] Filed: Jan. 7, 1981

[30] Foreign Application Priority Data

Jan. 15, 1980 [DE] Fed. Rep. of Germany ..... 3001261

[51] Int. Cl.[3] ..... B21C 3/02; B21C 3/12

[52] U.S. Cl. ..... 72/467; 76/107 A

[58] Field of Search ..... 72/467, 274; 76/107 A, 76/4, DIG. 12

[56] References Cited

U.S. PATENT DOCUMENTS

| | | | |
|---|---|---|---|
| 406,671 | 7/1889 | Sawyer | 72/467 |
| 776,072 | 11/1904 | Krause | 72/467 |
| 978,302 | 12/1910 | Joyce | 72/274 |
| 1,624,027 | 4/1927 | Vollmer | 72/467 |
| 2,216,652 | 10/1940 | Romp | 76/107 A |
| 2,699,692 | 1/1955 | Kronouer et al. | 76/107 A |
| 2,778,250 | 1/1957 | Ploegsma | 76/107 A |
| 4,241,625 | 12/1980 | Corbin et al. | 72/467 |

FOREIGN PATENT DOCUMENTS

| | | | |
|---|---|---|---|
| 667809 | 3/1952 | United Kingdom | 76/107 A |

*Primary Examiner*—Daniel C. Crane

*Attorney, Agent, or Firm*—Frishauf, Holtz, Goodman & Woodward

[57] ABSTRACT

To provide intimate contact between a sinter body holding a drawing die in contact with a die support carrier, so that the setting will fit into a cup-shaped die holder, the carrier is a disk element having a base plate from which a stub leg, preferably in frusto-conical form, extends, defining a reentrant surface, the wider portion of which is spaced from the base plate, with a seating surface extending therefrom for the die, and the sinter body surrounding the die, extending into the reentrant surface defined by the conical projection of the stub leg from the base plate, and extending beyond the die, and fitting in the die holder, the setting being inserted in the die holder with the sinter body against the bottom of the cup-shaped die holder to accept compressive forces upon drawing of wire in the direction from the base plate through the diamond and then through the sinter holder, that is, reversed with respect to the customary direction, so that the sinter body will be placed under compression and in intimate direct contact with the die holder for efficient heat and force transfer.

5 Claims, 4 Drawing Figures

DIAMOND DRAWING DIE AND SETTING COMBINATION

The present invention relates to a drawing die made of diamond, and a setting therefor which includes a sintered body to hold the drawing die against the support, so that the drawing die, with the support and the sintered body thereon, can be placed in a holder or socket.

BACKGROUND

It has previously been proposed to position a diamond drawing die, that is, an essentially circular diamond pellet with a hole therethrough to draw wire through the hole on a steel support which is essentially pot-shaped. In cross section, the steel support has an essentially U shape. The diamond itself is secured in position in the steel support by a body of sintered material. The diamond is seated on the flat bottom wall of the pot-shaped steel support, centered and with its bore in alignment with a bore through the steel holder. The sintered body surrounds the diamond; the sintered material is usually a copper-nickel composition. The wire is introduced from the side of the sintered body, that is, from the open side of the pot-shaped holder, through the hole of the diamond, and drawn out from the other end, so that the wire drawing pull force which is exerted by the wire on the drawing die will be accepted directly by the steel support.

In operation, heat arising during drawing can be carried away and dissipated from the diamond directly on the steel support.

The diamond is hard and very brittle; it thus reacts to impacts or shocks by forming fissures, or by shattering. To have long life, it is thus necessary that the diamond drawing die be securely attached to its holder permitting no relative movement and, preferably, irremovably secured in the holder. The diamond itself must be suitably supported with respect to the pulling force exerted by the drawing apparatus. Preferably, it should be under essentially uniform stress with respect to all directions of application of force. It is particularly important to provide for good uniform support in axial and radial direction, with respect to the drawing opening. Any heat which arises should be carried away to the surrounding structure as quickly as possible.

The drawing die as described, that is, the diamond and its support combination, is subject to improvement. It is difficult to reliably attach the diamond to its support. There is little prestressing of the diamond and uneven support of the diamond to accept the drawing forces is difficult to avoid. It is particularly difficult to provide sufficient prestressing since friction occurs upon sintering of the sintering material with respect to the support element. The shape of the support element and of the diamond itself leads to heat transfer difficulty with respect to the socket or holder in which the diamond and its support is to be inserted. It would be desirable to have intimate contact between the sinter body, rather than between the steel support, and the holder for improved heat transfer. The intermediate wall portions of the cup-shaped support in which the diamond is located interferes with effective heat transfer.

THE INVENTION

It is an object to improve the support arrangement for a diamond drawing die, and more particularly to provide a diamond drawing die-support combination which is readily assembled in a holder or socket, insures efficient transfer of heat, and provides for essentially uniform radial and axial loading of the diamond itself.

Briefly, the carrier for the diamond is a disk-shaped element which has a base plate, and one side thereof formed with a stub leg extending essentially centrally from the base plate. The diamond is attached to the stub leg. A hole extends through the disk element, the stub leg, and is aligned with the drawing hole of the die. A sinter body is positioned essentially flush with the outer sides of the disk element, entirely surrounding the die and the stub leg, and formed with an opening through which the wire to be drawn can extend. The sinter body is, generally, shaped to fit into the die holder or socket.

Contrary to prior usage, the assembly which includes the carrier plate, the diamond, and the sinter body, is inserted into the die holder or socket so that the carrier plate faces the wire as it is being introduced, the sinter body accepting the forces which arise upon drawing the wire through the die. These forces are then directly transferred from the sinter body to the surrounding holder or socket. Thus, direct force transfer and direct heat transfer is provided between the diamond drawing die and the surrounding holder and socket, the diamond drawing die being securely heated in the sinter body which can be molded thereabout.

Preferably, and in accordance with a feature of the invention, the stub leg is formed with a reentrant surface so that the sinter body will be molded around the stub leg and form an interlocking connection therewith.

DRAWINGS

Figure 1:
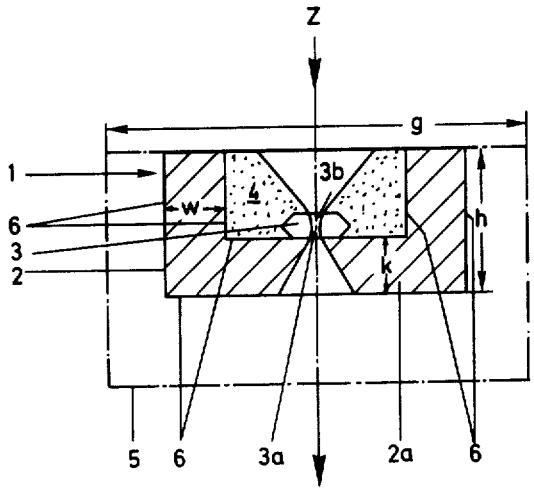
FIG. 1 PRIOR ART
FIG. 1 is a highly schematic axial sectional view through a die support assembly in a holder in accordance with the prior art.

A die support 1 has a generally cup-shaped support element 2 which, in cross section, is U-shaped. In plan view, the preferred form is circular, so that the support itself is essentially cup-shaped. The diamond drawing die element 3 is secured on the support. The outlet side surface 3*a* is centered on the flat bottom 2*a* of the support cup. The inlet side 3*b* faces a sinter body 4, located in the cup-shaped support. The sinter body 4 locates and places the diamond die element 3 in position in the support cup 2. The support 1 is fitted into a socket or holder 5, which does not form part of the present invention but in which the support is located, and which is so dimensioned and shaped that the support and setting 1 fits snugly therein. The bottom wall 2*a* is stressed in the direction of the pulling force Z against the socket 5, the bottom wall 2*a* being in contact with the socket 5. Heat transition zones are not only across the bottom wall 2*a*, but also across the side walls, as indicated at 6, where various heat transfer surfaces and regions are shown.

The diameter g of the socket is, for example, 25 mm; the height h, in one embodiment, about 8 mm. The thickness k of the bottom wall of the setting 1 is about 4 mm, and the wall thickness w about 4 mm. The setting element 2 is made of steel, and the sinter body 4 is made of copper and nickel.

Figure 2:
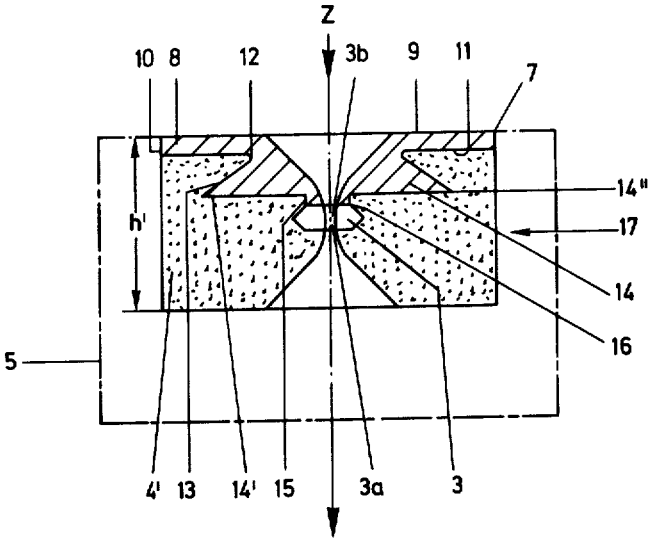
FIG. 2 is a view similar to FIG. 1, illustrating the die holder in accordance with the present invention.

The structure in accordance with the present invention is shown in FIG. 2: The die setting 17 for the diamond die element 3 is a table-like element 7 which has a base plate or disk 8, and a central stub leg 14 which has a central flat extension 15. The outer side walls 10 of the disk 8 fit into the socket 5. The stub leg 14 is centrally positioned on the base plate 8. The projection 15, preferably, is frusto-conical and has a flat end surface 16. The drawing diamond 3 is secured on the flat surface 16 of the projection 15 with its inlet side 3*b* facing the flat surface 16 of the projection 15. It is positioned on the surface by the sinter body 4'. The element 7 forming the central support is gripped by the sinter body 4', which extends flush with the side walls 10 of the base plate 8 beyond the base plate 8.

Figure 3:
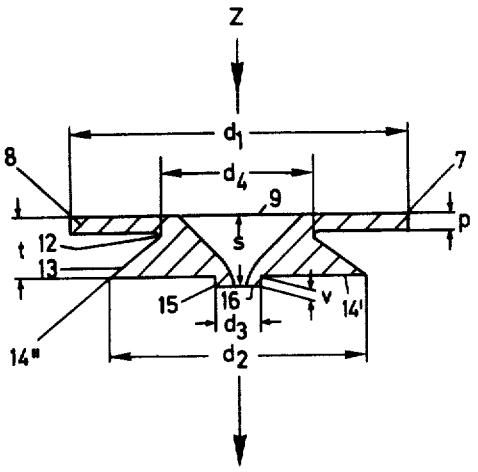
FIG. 3 is a detail view of the carrier disk for the diamond.
Figure 4:
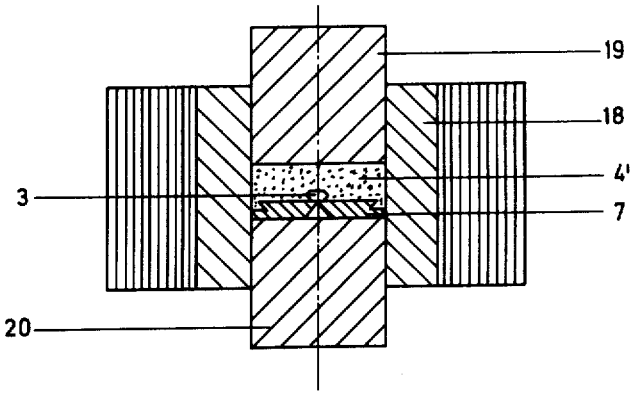
FIG. 4 is a longitudinal highly schematic sectional view illustrating the step in the manufacture of the carrier for the diamond die.

Preferably, the base plate 8—see FIGS. 2 and 3—has a circular ring-shaped surface 11 which is parallel to the outer base surface 9. The stub leg 14 extends in a reentrant surface configuration. The lower—FIGS. 2, 3—surface 11 of the base plate 8 has an inner edge 12 from which the stub leg extends with an inclined side surface 13, in frusto-conical shape, which, in the direction of the pulling force Z, projects outwardly for a distance t (FIG. 3), terminating in a flat surface 14' and forming the end of the stub leg. The end of the stub leg has an edge 14''. Preferably, the disk is constructed in a certain way which provides for effective transfer of drawing forces while securely maintaining the drawing die 3 in position. The following dimensions are defined:

Diameter of base plate 8: $d_1$
diameter of maximum dimension of stub leg 14: $d_2$
diameter of surface 16 supporting the die 3: $d_3$
diameter of inner edge 12 from which stub leg extends: $d_4$
distance between top surface 9 of disk 8 and bottom surface of leg 14: t
thickness of disk 8: p
height of projection 15: v.

Preferably, the relationships are as follows:

$d_1/d_2$: 8:9 to 7:9, preferably, 4:5
$d_4/d_1$: 17:25
$d_3/d_1$: 1:6 to 1:7, preferably 4:25
t/s: 3.5:4.5
$s=t+v$
p/t: 1:3.5
s/h' (FIG. 2): 4.5:8 to 4.5:10, preferably 4.5:8.
h' is the total thickness of the diamond die setting, including the sinter body 4'. A suitable dimension is about 8 mm.

We claim:

1. Diamond drawing die and die setting combination adapted for insertion in a separate die holder (5), the die holder being cup-shaped and having upstanding inner wall portion, an open end and a bottom wall;

said die and die setting combination comprising a carrier (7) including a disk portion forming a base plate (8) and having a side surface (10) extending along the outer peripheral edge of said disk fitting into the upstanding inner wall portions of the holder, and a stub leg (14) extending essentially centrally from the base plate having conical side surfaces and a die seating surface (16) opposite the base plate, one side of said die (3) being secured to said seating surface;

a central opening formed through the base plate and the stub leg and in alignment with the die drawing openings; and a sinter holding body (4') in the form of a molded body positioned essentially flush with the side surface (10), surrounding portions of the die and the stub leg including the conical surface thereof, and shaped to fit into the cup shaped die holder, said carrier and die being fitted in the die holder so that the carrier extends across the die holder opening with the side surface engaging the inner wall of the die holder and the sinter holding body being positioned intermediate the bottom wall and the open end of said die holder with the sinter holding body in engagement with the bottom wall and upstanding inner wall, a side of said die opposite said one side being solely supported by said sinter holding body and said plate and die being arranged for drawing of wire through the combination in the direction first through the base plate and the stub leg, then through the die, and then through the sinter body to place the sinter body in compression and, in use, in direct contact with the die holder (5).

2. Combination according to claim 1, wherein the stub leg is formed with a reentrant outer surface (13), and the sinter body fits around said reentrant surface.

3. Combination according to claim 2, wherein said reentrant surface includes said conical side surfaces, in which said conical surfaces diverge in the direction of drawing of wire through the die.

4. Combination according to claim 1, wherein the base plate (8) is essentially circular and has a diameter $d_1$;

the stub leg (14) is frusto-conical and has a maximum dimension $d_2$ and a minimum dimension $d_4$ at its junction with the base plate (8);

said die seating surface (16) is circular and has a diameter $d_3$;

an essentially cylindrical projection extending from said frusto-conical stub leg and defining said seating surface (16) and having a height v;

the total thickness of said carrier (7) being s;

the dimension of the top face of the base plate to the bottom face of the frusto-conical stub leg being t;

the thickness of the base plate (8) being p;

the overall height of said combination from the end face of said base plate (8) to the opposite end face of the sinter body being h', forming the total thickness of the diamond die setting;

and wherein the relative dimensions are defined as follows:

$d_1/d_2$: 8:9 to 7:9
$d_4/d_1$: 17:25
$d_3/d_1$: 1:6 to 1:7
t/s: 3.5:4.5
$s=t+v$
p/t: 1:3.5
s/h': 4.5:8 to 4.5:10

5. Combination according to claim 4, wherein the ratio $d_1/d_2$ is about 4:5; $d_3/d_1$ is about 4:25; and s/h' is about 4.5:8.

* * * * *